United States Patent [19]

Menge

[11] Patent Number: 4,814,733

[45] Date of Patent: Mar. 21, 1989

[54] HIGH-VOLTAGE TRANSFORMER

[75] Inventor: Günter Menge, Assen, Fed. Rep. of Germany

[73] Assignee: Thomson-CGR, Paris, France

[21] Appl. No.: 123,108

[22] PCT Filed: Feb. 17, 1987

[86] PCT No.: PCT/FR87/00042

§ 371 Date: Oct. 19, 1987

§ 102(e) Date: Oct. 19, 1987

[87] PCT Pub. No.: WO87/05148

PCT Pub. Date: Aug. 27, 1987

[30] Foreign Application Priority Data

Feb. 21, 1986 [DE] Fed. Rep. of Germany ..... 3605629

[51] Int. Cl.[4] ..... H01F 15/14; H01F 27/30

[52] U.S. Cl. ..... 336/69; 336/90; 336/198; 336/206; 336/225

[58] Field of Search ..... 336/198, 208, 69, 228, 336/206, 90, 92, 98, 209, 225

[56] References Cited

U.S. PATENT DOCUMENTS

| | | | |
|---|---|---|---|
| 2,378,791 | 6/1945 | Robinson et al. | 336/206 |
| 3,652,968 | 3/1972 | Johnston et al. | 336/208 XR |
| 3,909,761 | 9/1975 | Miles | 336/208 XR |
| 3,939,450 | 2/1976 | Donnelly | 336/208 XR |
| 4,000,483 | 12/1976 | Cook et al. | 336/198 XR |
| 4,363,014 | 12/1982 | Leach et al. | 336/208 XR |

FOREIGN PATENT DOCUMENTS

| | | | |
|---|---|---|---|
| 2301519 | 10/1973 | Fed. Rep. of Germany | 336/198 |
| 2500293 | 8/1976 | Fed. Rep. of Germany | 336/198 |
| 2422236 | 12/1979 | France | 336/208 |

*Primary Examiner*—Thomas J. Kozma

*Attorney, Agent, or Firm*—Oblon, Fisher, Spivak, McClelland & Maier

[57] ABSTRACT

In a high-voltage transformer of particularly small size comprising a magnetic circuit and a coil shell on which is wound a secondary winding consisting of one or a number of separate secondary coils, each secondary coil is contained within a channel closed by an insulating ring made up of two segments. The two ring segments are assembled around the channel in a movement performed in the same plane as that of the channel.

12 Claims, 2 Drawing Sheets

HIGH-VOLTAGE TRANSFORMER

BACKGROUND OF THE INVENTION

1. Field of the Invention

This invention relates to a high-voltage transformer, especially for a diagnostic radiology generator and high-voltage supply units. The high-voltage generator of the type considered is supplied by a converter which is capable of operating at relatively high frequencies having maximum values in the vicinity of 100 kilohertz, for example.

2. Description of the Prior Art

A high-voltage transformer must not only have the requisite characteristics for the operation to be performed but must also entail low capital outlay in regard to raw materials and production costs, particularly in the case of industrial manufacture. These conditions are more difficult to satisfy as the high-voltage transformer has to meet more stringent design requirements of compactness and small size. The dimensions of a high-voltage transformer can be reduced in particular by optimizing the dimensions of the magnetic circuit or core employed, by choosing suitable material for the fabrication of this latter as well as a suitable operating frequency which can be made much higher than that of the power supply system by making use of a converter.

In fact, one of the determining parameters in the construction of a transformer is the magnetic sheet loss. Thus, the lower the losses and the higher the value of induction which can be chosen without exceeding the permissible tolerance of iron losses.

The high-frequency converter technique permits the use of relatively small magnetic circuits or cores, thus facilitating compact construction of the high-voltage transformer. In accordance with customary practice, the high-frequency converter delivers into a load circuit which includes the primary winding of the high-voltage transformer and an oscillating circuit, the resonance frequency of said oscillating circuit being related to the operating frequency of the converter. The frequency limits within which the converter is capable of operating are determined in particular by the semiconductors employed. Operating frequencies up to 100 kilohertz can be controlled without any problem by thyristors of the type in use at the present time.

However, as the dimensions of the high-voltage transformer are smaller in respect of a given value of high voltage, so it becomes more difficult to establish electrical insulation between the secondary winding and the primary winding and the transformer core so that, in the case of small dimensions of the transformer, this latter attains very high cost levels both in regard to the price of materials employed and in regard to complexity of operations involved in assembly.

SUMMARY OF THE INVENTION

The invention relates to a high-voltage transformer of the type which is intended to operate with a high-frequency converter while having particularly small dimensions in comparison with high-voltage transformers of the prior art. This result is obtained by means of a novel arrangement, especially in regard to electrical insulation, thereby permitting the use of inexpensive elements which can be readily assembled while also achieving improved conditions of electrical insulation.

In accordance with the invention, a high-voltage transformer of the type supplied by a high-frequency converter and having a magnetic circuit, a primary winding, a coil shell placed about a longitudinal axis of the magnetic circuit, a high-voltage secondary winding wound around the coil shell, the secondary winding being constituted by at least one secondary coil, said secondary coil being contained within a channel formed in the coil shell in a plane substantially perpendicular to the longitudinal axis, is distinguished by the fact that the channel containing the secondary coil is closed by an insulating ring formed by the assembly of at least two segments, the ends of said ring segments being disposed in interengaged relation on the one hand in order to form a labyrinth seal at the joints of said ring segments and on the other hand in order to assemble the ring segments by displacing said segments in substantially the same plane as that of the channel.

DETAILED DESCRIPTION OF THE INVENTION

Figure 1:
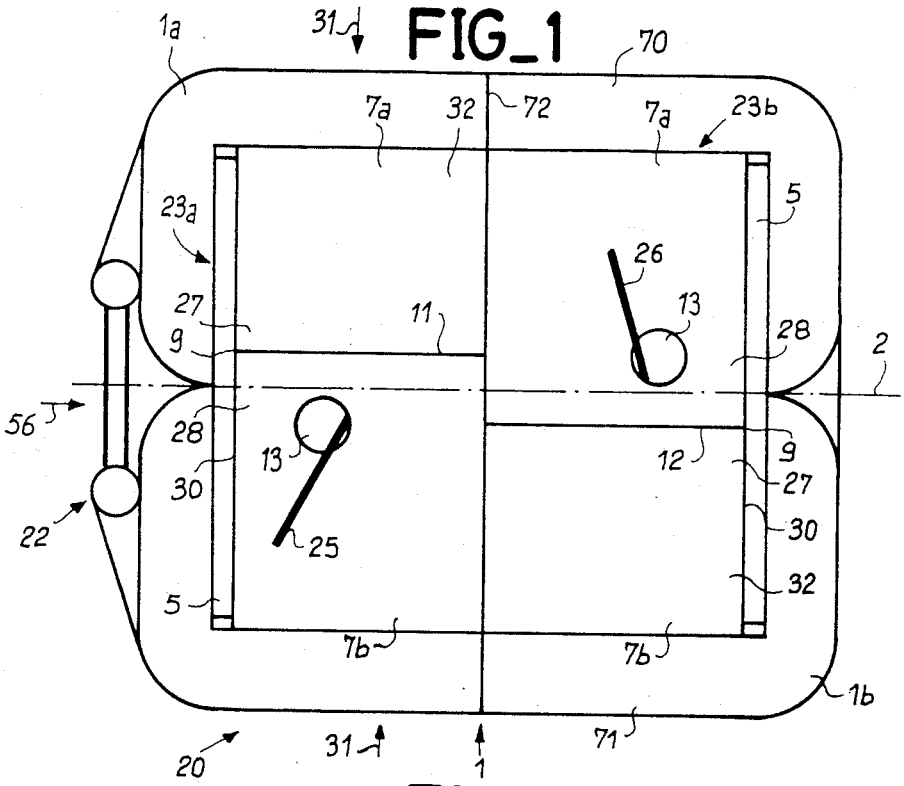
FIG. 1 is a general view of the transformer in accordance with the invention and shows in particular a magnetic circuit with insulating rings surrounding a coil shell.

FIG. 1 shows a high-voltage transformer 20 in accordance with the invention. The transformer 20 comprises a core or magnetic circuit 1 of conventional design. In the non-limitative example herein described, the magnetic circuit 1 has a central core (not shown in FIG. 1) disposed on a longitudinal axis 2 and two external legs 70, 71 which are parallel to the central core and closed on this latter. The transformer 20 includes a coil shell 5 which has a circular cross section in the non-limitative example herein described (the cross-section of the coil shell 5 does not appear in the figure since it is located in a plane at right angles to that of the figure). The coil shell 5 is disposed on the longitudinal axis 2 between the external legs 70, 71 of the magnetic circuit 1 and is substantially centered about the longitudinal axis 2. Said coil shell is adapted to carry a primary winding (not shown in FIG. 1) which is placed around the central core.

The coil shell 5 is intended to carry a secondary winding (not shown in FIG. 1) formed by at least one secondary coil. The secondary coil or coils are electrically isolated with respect to the magnetic circuit 1, on the one hand by the coil shell 5 which is of electrically insulating material, each secondary coil being also electrically isolated by means of an insulating ring 23*a*, 23*b*. In the non-limitative example described and illustrated in FIG. 1, two insulating rings 23*a*, 23*b* are illustrated. In other words, the secondary winding is formed by two separate secondary coils. However, it would clearly not constitute any departure from the spirit of the invention if the secondary windng were also to consist of a single secondary coil or of a plurality of separate secondary coils which are separate but electrically connected to each other so that only the two ends 25, 26 of the secondary winding are brought out from the insulating rings 23*a*, 23*b* (as illustrated in FIG. 1) by means of openings 13 formed in said insulating rings 23*a*, 23*b*. The openings 13 also serve as passages for circulation of insulating oil of a standard type (not shown) in which the transformer 20 is immersed. In a manner known per se, both insulating oil and transformer 20 are contained within a tank (not shown in the drawings).

The magnetic circuit 1 is divided into two portions 1*a*, 1*b* along a plane of separation 72 which is perpendicular to the longitudinal axis 2. The two portions 1*a*, 1*b* of the magnetic circuit 1 are joined and clamped together by means of a band-tightening device 22 after mounting within the magnetic circuit the primary winding and the coil shell 5 equipped with the secondary coil or coils as well as the insulating rings 23*a*, 23*b*.

As will hereinafter be explained in greater detail, each insulating ring 23*a*, 23*b* is intended to surround at least one secondary coil and, in accordance with a distinctive feature of the invention, each insulating ring 23*a*, 23*b* is formed by the assembly of at least two ring segments 7*a*, 7*b* having end portions 27, 28 of complementary shape, on the one hand in order to constitute a so-called labyrinth seal 9 at their joints located on their end faces 30 (said labyrinth seal being described further with reference to FIG. 4 which shows an insulating ring 23*a* in cross-section) and on the other hand in order to permit assembly of the ring segments 7*a*, 7*b* by displacing these latter in a radial direction illustrated by the arrows 31, that is to say in a movement carried out in a plane substantially perpendicular to the longitudinal axis 2. The assembly of the ring segments 7*a*, 7*b* in order to form an insulating ring 23*a*, 23*b* is carried out before mounting the coil shell 5 within the magnetic circuit 1. On an external face 32 of the insulating rings 23*a*, 23*b*, said ring segments 7*a*, 7*b* are joined together along lines 11 and 12 respectively in the case of the first and the second insulating rings 23*a*, 23*b*. These lines 11, 12 materialize leakage paths which are not in alignment with each other (as may be noted from FIG. 1), this result being obtained by positioning the two rings 23*a*, 23*b* in different relative positions about the longitudinal axis 2.

Figure 2:
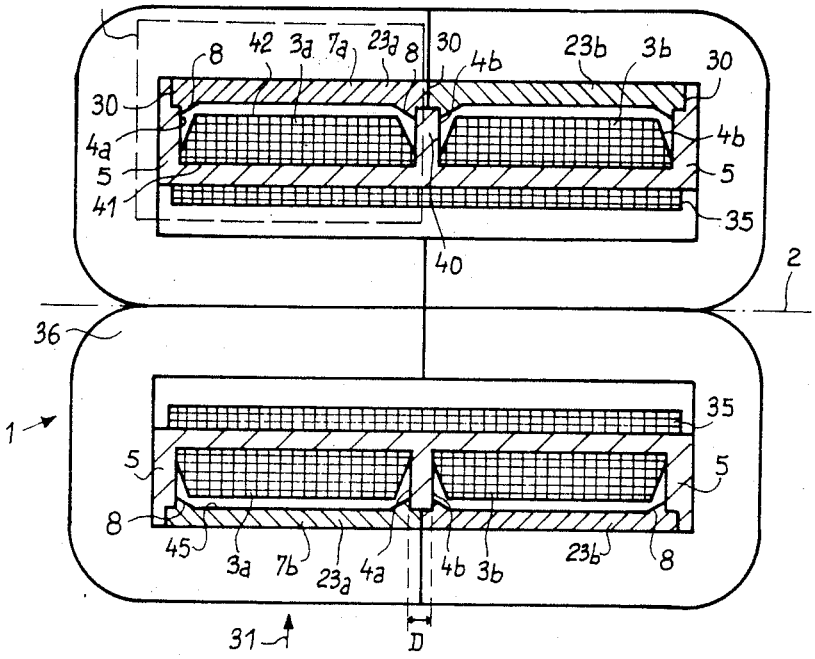
FIG. 2 is a sectional view which illustrates in greater detail the coil shell shown in FIG. 1 and which shows separate secondary coils constituting a secondary winding.

FIG. 2 shows by way of non-limitative example the manner in which the aforementioned secondary winding is constructed and arranged around the coil shell 5. Said coil shell is substantially centered about the longitudinal axis 2 and about the primary winding 35 and central core 36 mentioned earlier. In accordance with a distinctive feature of the invention, the secondary winding is formed by separate secondary coils 3*a*, 3*b* (two in number in the example herein described by way of example), said coils being each contained within a recess and electrically isolated from the rest of the transformer. Each recess consists of a channel 4*a*, 4*b* formed in the periphery of the coil shell 5. The channels 4*a*, 4*b* are disposed successively along the longitudinal axis 2 in planes substantially parallel to each other and substantially perpendicular to the longitudinal axis 2. Each channel 4*a*, 4*b* containing a secondary coil 3*a*, 3*b* is closed by an insulating ring 23*a*, 23*b*.

By adopting this subdivision of the high-voltage secondary winding into a plurality of secondary coils 3*a*, 3*b* each placed within a channel 4*a*, 4*b*, it is possible on the one hand to ensure perfect electrical isolation of each coil with respect to the primary winding 35 and with respect to the magnetic circuit 1 and on the other hand to reduce the voltage between bottom and top layers of a coil.

The coil shell 5 and the insulating rings 23*a*, 23*b* are of electrically insulating material which is characterized in particular by high dielectric strength and a high dielectric constant. The object thereby achieved is to permit a reduction in thickness of the insulating rings 23*a*, 23*b* and of the walls forming the channels 4*a*, 4*b* with a view to reducing the dimensions and weight of the transformer in accordance with the invention.

In accordance with another characteristic property which plays an important part in the present invention and has the effect of reducing the size of the transformer along the longitudinal axis 2, each insulating ring 23*a*, 23*b* is constituted by at least two ring segments 7*a*, 7*b* as already mentioned earlier. These two ring segments are assembled together in a movement which is represented by the arrows 31 in FIGS. 1 and 2 and takes place in the same plane as that of the channel 4*a*, 4*b* which is to be closed.

This arrangement results in the first place in great ease of assembly and in simplified manufacture by reason of the fact that the secondary coils 3*a*, 3*b* can be formed together or successively on the common coil shell 5. In the second place, each secondary coil can be encapsulated independently of the other secondary coils. In other words, each channel 4*a*, 4*b* can be closed by an insulating ring 23*a*, 23*b* in any desired order.

A further result achieved by the arrangement mentioned above and arising from the radial movement performed by the ring segments 7*a*, 7*b* in order to form a ring 23*a*, 23*b* while closing a channel 4*a*, 4*b* lies in the fact that the distance D between two successive secondary coils 3*a*, 3*b* can be considerably reduced. In the prior art, however, when it was desired to encapsulate a coil on all sides and to increase the lengths of leakage paths by means of a labyrinth seal, it was the usual practice to make use of a casing formed by two half-casings assembled together in an axial movement. In the prior art, when it was desired to form a secondary winding by means of a number of separate coils, it was consequently necessary to provide a substantial distance between the coils in a direction parallel to the axis of these latter. On the contrary, in the case of the present invention, the distance D between two successive secondary coils 3*a*, 3*b* can correspond to the thickness which is just necessary to ensure electrical insulation by means of a wall 40 located between the two channels 4*a*, 4*b*. In fact, the lateral edges 30 of two insulating rings 23*a*, 23*b* can even be juxtaposed as shown in FIG. 2. This permits a substantial reduction in size of the transformer in accordance with the invention, this feature being made even more advantageous by the fact that the secondary winding is formed by a greater number of secondary coils. It is accordingly within the spirit of the invention to provide more than two secondary coils 3*a*, 3*b*.

In accordance with another distinctive feature of the invention which permits enhanced electrical insulation, a secondary coil 3*a*, 3*b* within a channel 4*a*, 4*b* has a trapezoidal shape. The base 41 of the trapezoid is oriented towards the coil shell 5 and the top side 42 of the trapezoid is oriented towards the insulating ring 23*a*, 23*b*. By means of projecting portions 8 formed on the internal face 45 of each insulating ring 23*a*, 23*b*, the secondary coil of trapezoidal shape has the effect of increasing the efficiency of electrical insulation provided by insulating layers (not shown in FIG. 2) placed between the layers of electric conductors which form a secondary coil 3*a*, 3*b*.

Figure 3:
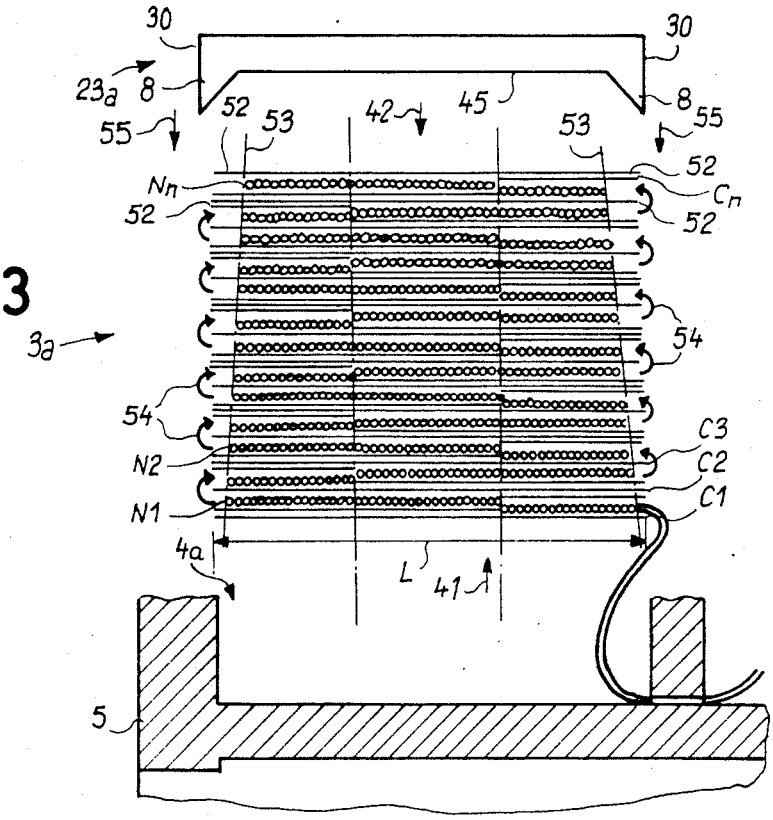
FIG. 3 is an enlarged view of the rectangular portion in dashed outline of FIG. 2 and illustrates constructional secondary details of a secondary coil.

FIG. 3 is an enlarged view of the rectangular portion 75 surrounded by a dashed outline in FIG. 2 and showing in greater detail the action of the projecting portions 8 on insulating layers formed on the first secondary coil 3*a*, this example being also applicable to the second secondary coil 3*b*.

For the sake of enhanced clarity of FIG. 3, the first secondary coil 3*a* has been moved away from the first channel 4*a* which is illustrated in a fragmentary view. The first insulating ring 23*a*, only part of which is shown in this figure, is located above the first secondary coil 3*a* and has also been moved away from this latter.

The secondary coil 3*a* is provided between its base 41 and its top side 42 with a succession of layers of wires N1, N2 . . . , Nn. In the non-limitative example herein described, at least one layer Cl, C2, . . . Cn of electrically insulating material is placed between each layer of wires N1 to Nn. The insulating layers Cl to Cn have substantially the same width L, with the result that these insulating layers have ends 52 which project with respect to the limits 53 of the first secondary coil 3*a* and project to a greater distance as they are located nearer the top side 42 of said coil. In FIG. 3, arrows 54 illustrate by way of non-limitative example the direction of winding of said first secondary coil 3*a*.

This arrangement in which the insulating layers C1 to Cn have a constant width L corresponding substantially to the width of the channel 4*a* whereas the secondary coil 3*a* is of trapezoidal shape inherently permits the possibility of increasing the electrical insulation between the different layers of wires N1 to Nn, and to a greater extent as the distance from a given layer to the top side 42 of the coil is shorter. In addition, the insulating ring 23*a* is provided with two projecting portions 8 each formed on its internal face 45 in proximity to a lateral edge 30 and these projecting portions 8 penetrate into the channel 4*a* when this latter is closed by the insulating ring 23*a*. The result thereby achieved is that the insulating ends 52 located near the top side 42 are downwardly displaced by the projecting portions 8 towards the base 41 as indicated schematically by second arrows 55, that the insulating layers located near the top side 42 are consequently closed towards the base 41 and that the top side 42 of the coil at which the highest voltage is developed is thus surrounded by the largest mass of insulating material.

In addition to the insulating rings 23*a*, 23*b* which close the channels 4*a*, 4*b* and which are in turn closed by labyrinth seals 9, the arrangement described in the foregoing makes it possible to provide leakage paths of infinite length at the level of each secondary coil 3*a*, 3*b* in spite of the small dimensions of the high-voltage transformer in accordance with the invention.

Figure 4:
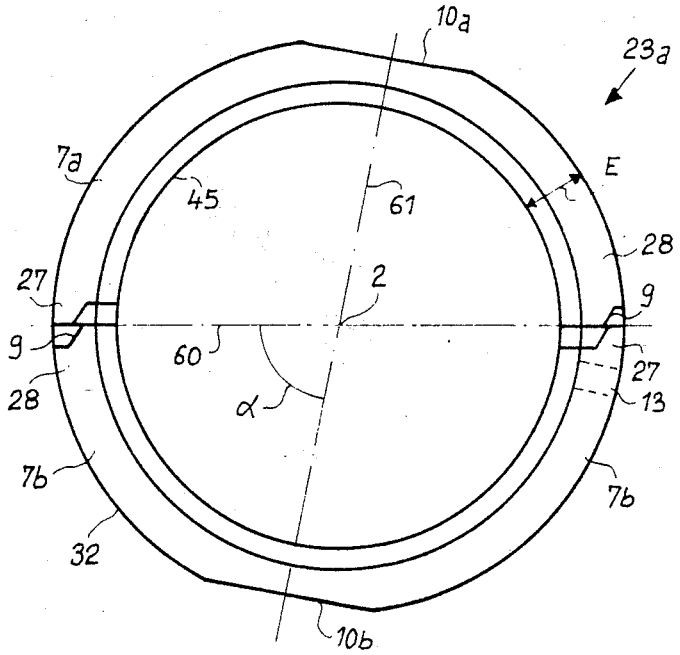
FIG. 4 is a view on a plane perpendicular to a longitudinal axis of the magnetic circuit shown in FIG. 1 and illustrates an insulating ring formed of two segments, the joints of which constitute labyrinth seals.

FIG. 4 is a sectional view of an insulating ring 23*a*, 23*b* taken along a line indicated in FIG. 1 by an arrow 56. Since the longitudinal axis 2 is perpendicular to the plane of FIG. 4, said axis is represented by a point at the center of the insulating ring 23*a*.

As mentioned earlier, the insulating ring 23*a* is formed by the assembly of two ring segments 7*a*, 7*b* joined together at their ends 27, 28.

Two joints 9 are thus formed by coupling the two ends 27, 28 of each ring segment 7*a*, 7*b*. As is apparent from FIG. 4, the shapes of the ends 27, 28 considered in the direction of the thickness E of the insulating ring 23*a* are irregular and complementary, with the result that their joints 9 each constitute a labyrinth seal (which materializes a leakage path), the length of which is much greater than the thickness E. An important feature lies in the fact that the ring segments 7*a*, 7*b* can be assembled together by subjecting at least one of the two ring segments to a movement of radial displacement along an assembly axis 60, this axis being contained in a plane perpendicular to the longitudinal axis 2.

In the non-limitative example shown in FIG. 4, it is observed that the two joints 9 progress in the same manner from the external face 32 to the internal face 45 of the insulating ring 23*a*. The result thereby achieved in particular is that the ring segments 7*a*, 7*b* are interchangeable for the purpose of forming an insulating ring 23*a*, 23*b*. By engaging in each other, the ends 27, 28 of the ring segments 7*a*, 7*b* constitute an effective closure of the so-called "snap-in" type.

As can readily be understood, it would remain within the spirit of the invention to consider different profiles of labyrinth seals 9, the important requirement being to permit radial assembly of at least two elements in order to form an insulating ring 23*a*, 23*b*.

Each ring segment 7*a*, 7*b* is provided on the outer face 32 with a flat portion 10*a*, 10*b* which is intended to be located opposite to the external legs 70, 71 of the magnetic circuit 1. These two flat portions 10*a*, 10*b* serve to define the angular position of the labyrinth seals 9 and of the first joints 11, 12 shown in FIG. 1. The two flat portions 10*a*, 10*b* are centered on a positioning axis 61 extending along a diameter of the insulating ring 23*a*, 23*b* and inclined with respect to the assembly axis 60 at an angle which is slightly smaller than 90°. This makes it possible to ensure in particular that the first joints 11, 12 (shown in FIG. 1) which represent leakage paths are not aligned in respect of two successive insulating rings 23*a*, 23*b*.

All the foregoing arrangements as well as small manufacturing tolerances of each component make it possible to obtain minimum wall thicknesses, leak-tight assemblies and casings which are practically homogeneous around the secondary coils 3*a*, 3*b*, with the result that no flashover voltage is liable to occur.

Should excessive gaps nevertheless appear in spite of the very close tolerances imposed in the manufacture of each component of the coil shell 5 and of the insulating rings 23*a*, 23*b*, such gaps are eliminated at the time of an evacuation process, particularly in order to carry out filling of the high-voltage transformer with insulating oil. The high-voltage transformer can also be heated to a temperature of approximately 80°, for example. During this heating operation, the polypropylene is consequently cured and acquires a uniform shape.

What is claimed is:

1. A high-voltage transformer of the type supplied by a converter and comprising a magnetic circuit, a primary winding, a coil shell placed about a longitudinal axis of the magnetic circuit, a high-voltage secondary winding wound around the coil shell, said primary winding being surrounded by the high-voltage secondary winding, the secondary winding being constituted by at least two separate secondary coils, each of said secondary coils being contained within a separate channel formed in the coil shell in a plane substantially perpendicular to the longitudinal axis, the two channels being disposed successively along the longitudinal axis, wherein each of the channels containing a secondary coil is closed by an insulating ring formed by the assembly of at least two segments, the ends of said ring segments being disposed in interengaged relation on the one hand in order to form a labyrinth seal at the joints of said ring segments and on the other hand in order to assemble the ring segments by displacing said segments in substantially the same plane as that of the channel.

2. A transformer according to claim 1, wherein the movement involved in the assembly of ring segments takes place solely along an assembly axis which is contained in a plane perpendicular to the longitudinal axis.

3. A transformer according to claim 1, wherein the insulating ring is provided on the external surface thereof with two diametrically opposite flat portions each intended to be located opposite to one external leg of the magnetic circuit.

4. A transformer according to claim 3, wherein the flat portions are centered on a positioning axis inclined at an angle smaller than 90° with respect to a radial axis which passes through the longitudinal axis and the ends of the ring segments.

5. A transformer according to claim 1, wherein at least one secondary coil has a trapezoidal shape and wherein layers of wires constituting the secondary coil from the base to the top side thereof are separated by layers of insulating material having a constant width.

6. A transformer according to claim 5, wherein at least one insulating ring is provided on the bottom face thereof with projecting portions which penetrate into the channel in order to subject the projecting ends of the insulating layers to a downward displacement towards the bottom of the channel.

7. A transformer according to claim 5, wherein the top side of the secondary winding is oriented towards the insulating ring.

8. A transformer according to claim 1, wherein the coil shell is of polypropylene.

9. A transformer according to claim 1, wherein at least one insulating ring is of polypropylene.

10. A transformer according to claim 1, wherein the magnetic circuit is divided into two portions along a plane perpendicular to the longitudinal axis, said two portions being assembled in juxtaposed relation after mounting the coil shell.

11. A transformer according to claim 1, wherein the coil shell is common to all the secondary coils.

12. A transformer according to claim 1, wherein the two ring segments are interchangeable.

* * * * *